US008430623B2

(12) United States Patent
Beckford et al.

(10) Patent No.: US 8,430,623 B2
(45) **Date of Patent: *Apr. 30, 2013**

(54) BLADE

(75) Inventors: Peter Rowland Beckford, Derby (GB); Simon Read, Derby (GB); Ian Colin Deuchar Care, Derby (GB)

(73) Assignee: Rolls-Royce PLC (GB)

( * ) Notice: Subject to any disclaimer, the term of this patent is extended or adjusted under 35 U.S.C. 154(b) by 643 days.

This patent is subject to a terminal disclaimer.

(21) Appl. No.: 12/547,573

(22) Filed: Aug. 26, 2009

(65) Prior Publication Data

US 2010/0054937 A1 Mar. 4, 2010

(30) Foreign Application Priority Data

Aug. 27, 2008 (GB) ..... 0815475.9

(51) Int. Cl.
*F01D 5/30* (2006.01)

(52) U.S. Cl.
USPC ..... 415/9; 416/2; 416/219 R; 416/229 R

(58) Field of Classification Search ..... 415/9; 416/2, 416/219 R, 229 R, 234, 239
See application file for complete search history.

(56) References Cited

U.S. PATENT DOCUMENTS

| | | | |
|---|---|---|---|
| 2,362,804 A | 11/1944 | Cox, Jr. | |
| 2,859,936 A | 11/1958 | Warnken | |
| 2,925,250 A | 2/1960 | Whitehead | |
| 3,057,767 A | 10/1962 | Kaplan | |
| 3,132,841 A | 5/1964 | Wilder, Jr. | |
| 3,519,368 A | 7/1970 | Howald et al. | |
| 3,679,324 A | 7/1972 | Stargardter | |
| 3,694,104 A | 9/1972 | Erwin | |
| 3,744,927 A | 7/1973 | Bernaerts | |
| 3,749,518 A | 7/1973 | Alver et al. | |
| 3,756,745 A | 9/1973 | Alver et al. | |
| 4,037,990 A | 7/1977 | Harris | |
| 4,040,770 A | 8/1977 | Carlson | |
| 4,111,600 A * | 9/1978 | Rothman et al. | 416/2 |

(Continued)

FOREIGN PATENT DOCUMENTS

| | | |
|---|---|---|
| EP | 1555391 A2 | 7/2005 |
| EP | 1881158 A2 | 1/2008 |

(Continued)

OTHER PUBLICATIONS

European Search Report dated Sep. 7, 2012 in corresponding EP Patent Application No. 09251847.

*Primary Examiner* — Edward Look
*Assistant Examiner* — Liam McDowell
(74) *Attorney, Agent, or Firm* — McCormick, Paulding & Huber LLP

(57) ABSTRACT

A fan blade for a gas turbine engine has an aerofoil part and a root part. The root part includes a root former; the root former 18 includes a zone of weakness, which reduces the ability of the root part to withstand an impact force. Thus, in an impact situation in which the fan blade has separated from the fan rotor and the fan blade has itself separated into fragments, the root part will fracture or buckle more easily than would be the case with conventional arrangements. This will lower the impact force of the root part upon the fan casing, thus permitting the fan casing to be designed to withstand lower impact forces. The fan casing can therefore be made lighter, and cheaper, than in conventional arrangements.

4 Claims, 6 Drawing Sheets

U.S. PATENT DOCUMENTS

| | | | | |
|---|---|---|---|---|
| 4,343,593 | A | 8/1982 | Harris | |
| 4,492,521 | A | 1/1985 | Pask et al. | |
| 4,730,984 | A * | 3/1988 | Ortolano | 416/222 |
| 5,018,271 | A * | 5/1991 | Bailey et al. | 29/889.71 |
| 5,102,302 | A | 4/1992 | Schilling et al. | |
| 5,160,243 | A | 11/1992 | Herzner et al. | |
| 5,176,499 | A | 1/1993 | Damlis et al. | |
| 5,314,307 | A | 5/1994 | Farmer | |
| 5,340,280 | A * | 8/1994 | Schilling | 416/229 A |
| 5,405,102 | A | 4/1995 | Greene | |
| 5,443,367 | A * | 8/1995 | Samit et al. | 416/248 |
| 5,490,764 | A * | 2/1996 | Schilling | 416/239 |
| 5,749,706 | A | 5/1998 | Maar | |
| 6,402,469 | B1 | 6/2002 | Kastl et al. | |
| 6,431,837 | B1 * | 8/2002 | Velicki | 416/223 R |
| 6,467,168 | B2 * | 10/2002 | Wallis | 29/889.721 |
| 6,536,208 | B1 | 3/2003 | Kretschmer | |
| 6,609,884 | B2 * | 8/2003 | Harvey | 415/115 |
| 6,739,049 | B2 * | 5/2004 | Nicholson | 29/889.72 |
| 7,025,560 | B2 | 4/2006 | Clark | |
| 7,112,044 | B2 | 9/2006 | Whitehead et al. | |
| 7,118,346 | B2 | 10/2006 | Read | |
| 7,311,500 | B2 | 12/2007 | Rongong et al. | |
| 7,448,845 | B2 | 11/2008 | Stephenson et al. | |
| 7,758,311 | B2 | 7/2010 | Loehle et al. | |
| 8,016,561 | B2 * | 9/2011 | Moniz et al. | 416/97 R |
| 2005/0158171 | A1 * | 7/2005 | Carper et al. | 415/200 |
| 2008/0019838 | A1 * | 1/2008 | Read et al. | 416/243 |
| 2010/0054938 | A1 * | 3/2010 | Beckford et al. | 416/2 |

FOREIGN PATENT DOCUMENTS

| | | | |
|---|---|---|---|
| FR | 2712631 | A | 5/1995 |
| GB | 1332679 | | 11/1970 |
| GB | 1473417 | | 5/1977 |
| GB | 2323637 | A | 9/1998 |
| GB | 2399866 | A | 9/2004 |
| JP | 9089709 | A | 4/1997 |
| WO | 96/34181 | | 10/1996 |
| WO | 2007048996 | A1 | 5/2007 |

* cited by examiner

BLADE

CROSS REFERENCE TO RELATED APPLICATION

This application is entitled to the benefit of British Patent Application No. GB 0815475.9, filed on Aug. 27, 2008.

FIELD OF THE INVENTION

The present invention relates to a blade, particularly but not exclusively a blade for a gas turbine engine.

BACKGROUND OF THE INVENTION

A turbofan gas turbine engine comprises a fan, which comprises a fan rotor and a number of circumferentially spaced radially outwardly extending fan blades secured to the fan rotor. The fan is surrounded by a fan casing, which defines a fan duct. The fan casing is arranged to contain one or more of the fan blades in the unlikely event that a fan blade becomes detached from the fan rotor. Safety regulations dictate that the worst case of this scenario—in which the whole blade is released—must be provided for in the design of the fan casing.

If a fan blade becomes detached from the fan rotor, the released fan blade will strike a main fan casing containment region. The fan blade will generally break up progressively under a buckling action. The fan blade increases in strength from the tip to the root and at some position between the tip and the root the remaining portion of the fan blade, including the root, will no longer buckle. The remaining portion of the fan blade has substantial mass and will be accelerated to impact a rear fan containment region of the fan casing.

It is necessary to provide additional material to the rear fan containment region of the fan casing to contain the remaining portion of the fan blade. The additional material may be in the form of an increase in thickness, the provision of ribs, honeycomb liners etc, which dissipate the impact energy by plastic deformation of the material. However, these methods of protecting the rear fan containment region add weight to the turbofan gas turbine engine.

It is known to provide apertures or passages in the root to promote break up of the root upon impact such that there is a reduced load placed upon the rearward portions of the fan casing. This permits a reduction in the reinforcement required in the casing and a reduction of weight.

In the case of fan blades formed of metal, such apertures or passages can be formed by drilling. In the case of blades formed of composite materials, drilling can provide a moisture path into the composite, which can lead to laminar cracking.

SUMMARY OF THE INVENTION

In accordance with the first aspect of the present invention, there is provided a blade for a turbine engine, the blade including an aerofoil part and a root part, the root part including a root former, the root former including a zone of weakness.

The root part may have a length, and the zone of weakness may be arranged to reduce the ability of the root part to withstand a force applied transversely across the length of the root part. The root part may be curved in the form of an arc, and the zone of weakness may reduce the ability of the root part to withstand a force applied transversely and radially across the arc.

The zone of weakness may extend transversely across the root former, and may extend radially transversely across the root former.

The root former may include a plurality of root former parts, and one zone of weakness may be located between adjacent root former parts.

The or each zone of weakness may be in the form of a line of weakness. The or each zone of weakness may be in the form of a line of separation. The or each zone of weakness may include a space defined between the adjacent root former parts. The or each space may be in the form of a hole, which may be in the form of a slot, a recess, a through hole, or a passage. The blade may include a filler material which is located in the space. The blade may include a containment member which extends around the space.

Each of the root former parts may include an end face, which may include a formation. The or each space may be defined between the end face formations of adjacent root former parts. The end face formations may be convex. One end face formation may be convex and the adjacent opposing end face formation may be correspondingly concave. The end face formations may include stipples or corrugations. One end face formation may be in the form of a lobe, and another, opposing adjacent end face formation may define a recess in which the lobe is receivable.

The root former may include a connector, which may extend between one root former part and an adjacent root former part.

The zone of weakness may include an internal space defined by the root former.

The blade may include an internal reinforcement structure, which may be surrounded by a settable material, and the blade may be formed by a process in which the settable material flows around and permeates the structure and sets. The root former may be received within the structure. The structure may include one or more zones of weakness, the or each of which may correspond in position with the or each zone of weakness of the root former.

The blade may be a fan blade, and may be a fan blade for a gas turbine engine.

According to a second aspect of the present invention, there is provided a gas turbine engine, the gas turbine engine including a blade, the blade including an aerofoil part and a root part, the root part including a root former, the root former including a zone of weakness.

DETAILED DESCRIPTION OF THE PREFERRED EMBODIMENTS

Figure 1:
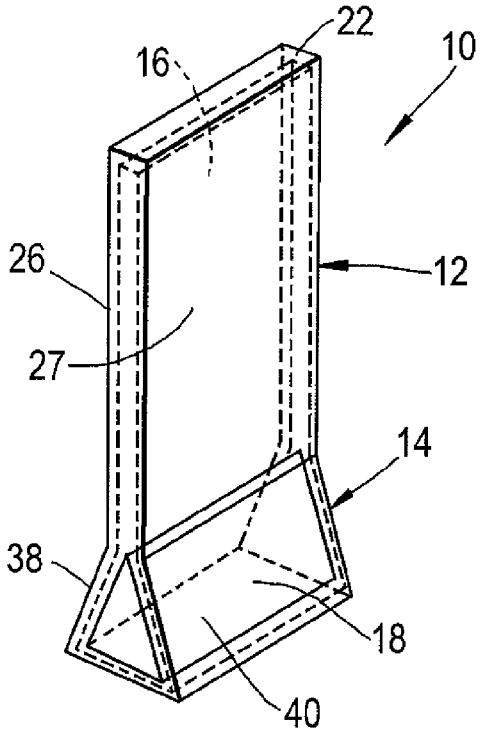
Fig.1 Prior Art
FIG. 1 is a perspective diagrammatic view of a blade.
Figure 2:
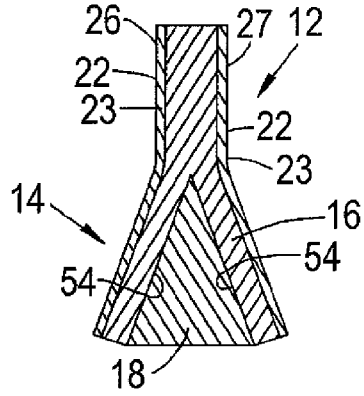
Fig.2 Prior Art
FIG. 2 is an end cross sectional view of a lower (root) part of the blade.

Referring to FIGS. 1 and 2, a known blade 10 includes an aerofoil part 12 and a root part 14, the aerofoil part 12 extending from the root part 14. The blade 10 includes a structural part 16 and a root former 18. The root former 18 is in the form of a wedge or prism, having a length, which extends transversely across the blade 10 and having a substantially triangular shape in cross section. The structure 16 in the example shown in FIG. 1 extends substantially throughout the aerofoil part 12 and along side walls 54 of the root former 18, so that the root former 18 is received within the structure 16. The blade 10 includes a settable material 22, which surrounds the structure 16 and the root former 18, and forms a surface layer 23. The root former 18 serves to splay the structure 16 to form the root part 14. The settable material 22 may be made from several layers, which impart properties of colour, erosion protection, surface finish, and the like.

In one example, the structure could be formed of carbon fibre composite and the settable material could be formed of a resin, plastic, paint. The root former 18 could be formed of carbon fibre, glass fibre, a mixture of the two, plastic (PEEK, PECK), or resin, which could be monolithic or laminated. The blade 10 could be formed by any suitable process, such as resin transfer moulding, preform lay-up, resin film infusion, or other composite method. The process could be a moulding process, in which the structure 16 and the root former 18 are introduced into a mould cavity and the mould cavity is then filled the settable material 22. The settable material 22 could surround and substantially or at least partially permeate the structure 16 and root former 18. The structure 16 and/or the root former 18 could be pre-impregnated, the settable material 22 being impregnated into the structure 16 and/or the root former 18 before introduction into the mould cavity.

Figure 3:
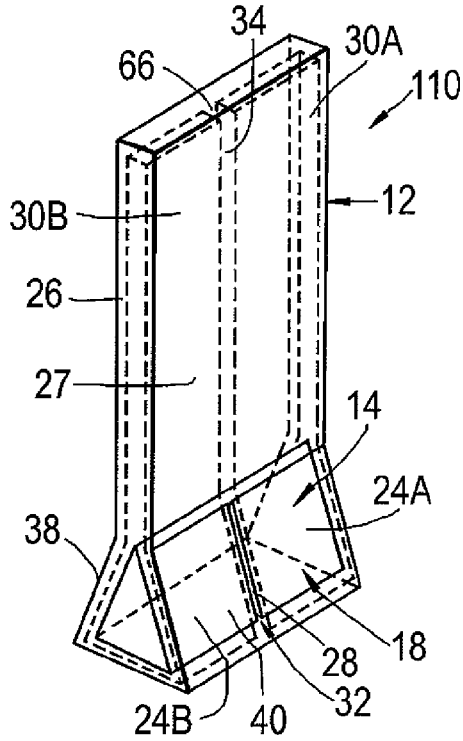
FIG. 3 is a perspective diagrammatic view of another blade.

FIG. 3 shows another blade 110, many features of which are similar to those described in relation to the blade shown in FIGS. 1 and 2. Where features are the same or similar the same reference numerals will be used, and only those features which are different will be described for the sake of brevity.

The blade 110 includes a structure 16 which is divided into two parts, a first structure part 30A and a second structure part 30B and a zone of weakness 66, the zone of weakness 66 including a space 34 defined between the first and the second structure parts 30A, 30B. The blade 110 includes a root former 18, which is divided into two parts, a first part 24A and a second part 24B. The root former 18 includes a zone of weakness 32, which includes a space 28 defined between the first and second parts 24A, 24B.

The blade 110 has a length, and the root part 14 has a length, which extends transversely relative to the length of the blade 110. The zone of weakness 66 of the structure 16 extends along the length of the blade 110. The zone of weakness 32 of the root former 18 extends transversely across the length of the root part 14. The position of the zone of weakness 66 of the structure 16 corresponds with, and is substantially aligned with, the position of the zone of weakness 32 of the root former 18. The zone of weakness 66, 28 need not be half way along the blade, but is preferentially positioned such that normal operating forces at this point are insufficient to initiate break-up. In some designs, there may be multiple zones of weakness, and preferentially these do not coincide with areas of high stress under normal running conditions.

The aerofoil part 12 includes a first face 26 and an oppositely facing second face 27. The root part 14 includes a first face 38 and an oppositely facing second face 40. Although each of these faces is shown as being planar in FIG. 1 for the purpose of simplicity, the skilled person will understand that one of the first or second faces of the aerofoil part 26, 27 and one of the first or second faces of the root part 38, 40 could be concave and the other of the faces of each of the parts could be convex. For example, the first face 26 of the aerofoil part 12 could be concave and the second face 27 of the aerofoil part 12 could be convex. Similarly and correspondingly, the first face 38 of the root part 14 could be convex and the second face 40 of the root part 14 could be concave.

Figure 4:
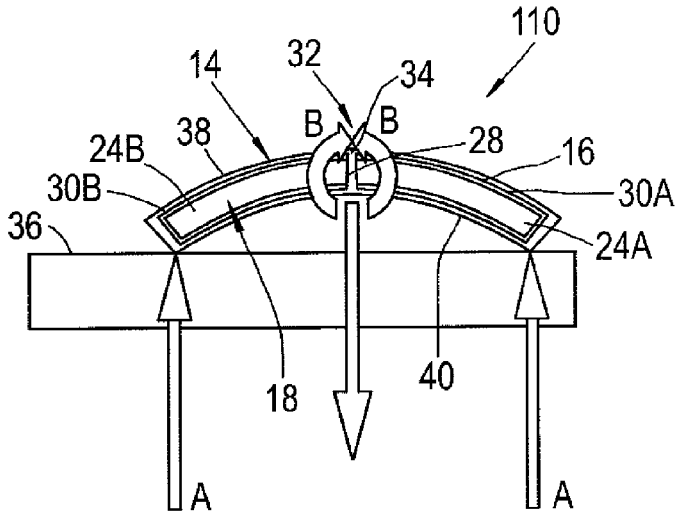
FIG. 4 is a schematic view of part of the blade of FIG. 3 in an impact condition.

Safety regulations dictate that in the unlikely event that the fan blade 110 detaches from its mounting for whatever reason, that the fan blade must be contained. To demonstrate the worst case of this the whole blade is always released. The released fan blade 110 impacts a containment region of the fan casing and progressively breaks up under a buckling action, leaving the root part 14 intact. FIG. 4 shows the root part 14 of the blade 110 striking a fan casing 36. In FIG. 4, the curvature of the root part 14 is shown, the root part 14 being in the form of an arc, with the convex face 38 and the concave face 40.

In an impact condition, the zone of weakness 32 in the form of the space, or weaker material, 28 between the root former parts 24A, 24B acts to weaken the root part 14, reducing the ability of the root part 14 to withstand one or more impact reaction forces indicated by arrows A applied by the fan casing 36 transversely across the length of the root part 14 and transversely radially across the arc of the root part 14, thus lowering the impact force or forces applied by the root part 14 on the fan casing 36. The lowering of the impact force thus permits the fan casing 36 to be designed to withstand a lower impact force, resulting in a saving of material weight as, for example, section thicknesses can be reduced. Thus, as shown in FIG. 4, in the impact condition, the root part 14 contacts the fan casing 36 resulting in reaction forces A being applied by the fan casing 36 upon the ends of the root part 14, resulting in the formation of a fracture across or through the space 28, in turn resulting in a relative hinging motion of the root parts 24A, 24B as shown by arrows B.

In the example shown in FIGS. 3 and 4, the structure zone of weakness 66 extends across the root part 14, thus contributing to the weakening of the root part 14 in the impact condition.

Various other modifications could be made without departing from the scope of the invention. The blade could be formed by any suitable process, and could be of any suitable size and shape. The blade could be hollow, and could be in the form of a honeycomb, and could be formed of composite or hybrid materials, or could be formed using powder metallurgy, sintering or metal deposition techniques. The structure 16 and the root former 18 could be formed of any suitable material. The settable material 22 could be formed of any suitable material.

The structure zone of weakness 66 could be different, and could be in the form of a line of weakness, or a line of separation, or could include a space defined between the adjacent structure parts 30A, 30B which could be in the form of a hole, or in the form of a slot, a recess, a through hole, or a passage.

The structure 16 could include any suitable number of structure zones of weakness 66. The root former 18 could include any suitable number of root former zones of weakness 32, which could be in any suitable position.

FIGS. 5A to 10D show examples of different possible forms of root former. As with previous embodiments, where features are the same or similar to those described previously, the same reference numerals have been used and only the differences will be described for the sake of brevity.

Figure 5A:
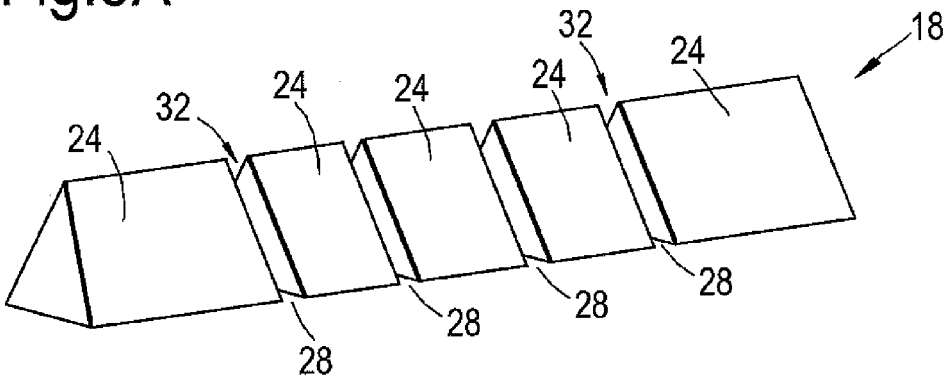
FIGS. 5A and 5B are perspective and side schematic views respectively of a first root former.
Figure 5B:
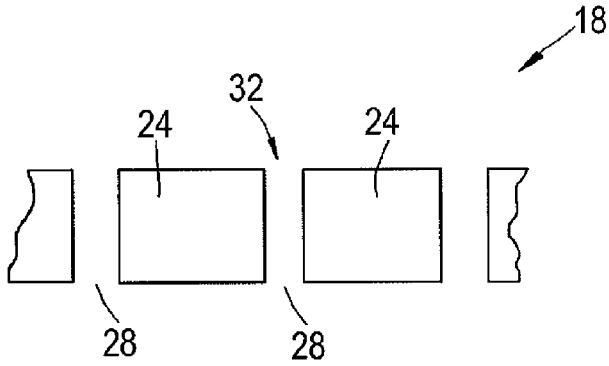

FIGS. 5A and 5B show a root former 18 which includes a plurality of root former parts 18 and zones of weakness 32, each zone of weakness 32 including a space 28 being defined between adjacent root former parts 24.

Figure 6A:
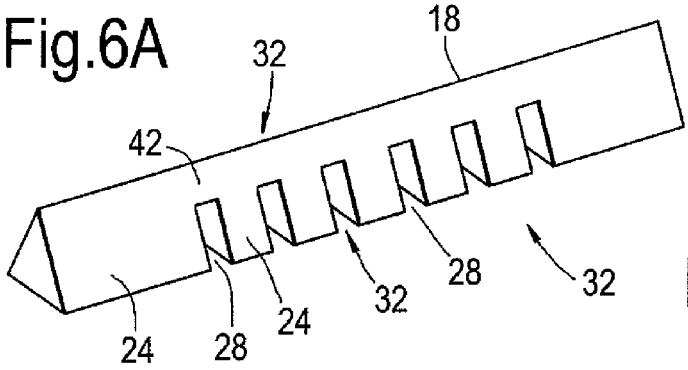
FIGS. 6A and 6B are perspective and side schematic views respectively of a second root former.
Figure 6B:
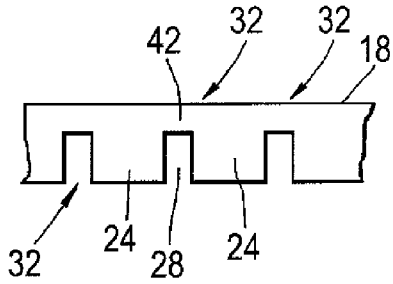

FIGS. 6A and 6B show a root former 18 including a plurality of root former parts 24 and connectors in the form of connecting parts 42 extending between adjacent root former parts 24, so that the spaces 28 between the root former parts 24 are in the form of channels or slots. The connectors aid handling and set up during the manufacturing process.

Figure 7A:
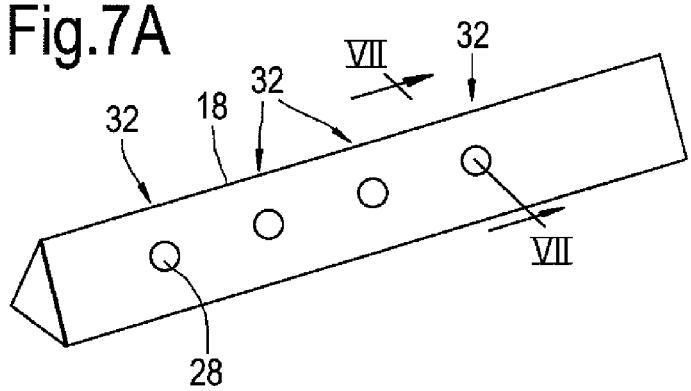
FIGS. 7A to 7D are perspective and end cross sectional views of third root formers.
Figure 7B:
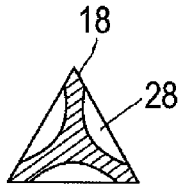
Figure 7C:
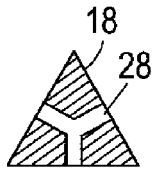
Figure 7D:
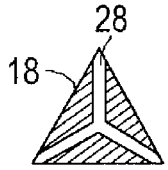

FIG. 7A shows a root former 18 including a plurality of zones of weakness 32, each zone of weakness 32 including a plurality of spaces, each space being in the form of a hole 28 defined by the root former 18. In one example, as shown in FIG. 7B, the holes 28 are in the form of recesses formed in the faces of the root former 18, for example, by a rotary saw or cutter. In another example, as shown in FIG. 7C, the holes 28 are in the form of passages, which could be formed by drilling, one passage 28 extending inwardly from each face of the root former 18, the passages 28 communicating with each other. In a further example, shown in FIG. 7D, the passages 28 extend inwardly from each of the three corners of the triangular section root former 18. These examples are not exhaustive and other shapes are possible.

Figure 8A:
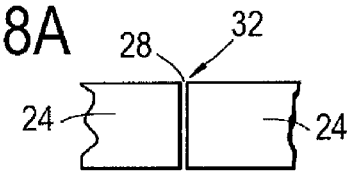
FIGS. 8A to 8M are side views of details of other root formers.

The space 28 between the root parts 24 could be of any suitable size. As shown in FIG. 5B, the spaces 28 could be relatively large, or as shown in FIG. 8A, the space 28 could be relatively small. In another example, the end faces of adjacent former parts 24 could abut, so that the zone of weakness is in the form of a line of separation, and the space 28 between the root former parts 24 is substantially zero.

Figure 8B:
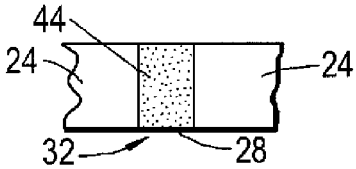

The space 28 between the root former parts 24 could be filled with any suitable material. In one example, the settable material 22 permeates to fill the space 28 during the formation of the blade, the settable material 22 being weaker than the root former material in resisting the impact forces. In another example, as shown in FIG. 8B, the root former 18 includes a filler 44, which is located in the space 28. The filler 44 could be formed of any suitable material. For example the filler 44 could be a syntactic paste (i.e. a non setting sticky material). In another example the filler 44 could be a foam. In another example, the filler material 44 could be a fluid, and could be a synovic fluid.

Figure 8C:
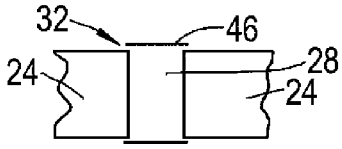

In the example shown in FIG. 8C, the root former 18 includes a containment member 46 in the form of a sleeve which extends around the space 28 between the root former parts 24 to contain material within the space 28, and also act as a connector between the root former parts 24.

The root former parts 24 could include formations, which are provided on opposed end faces of adjacent root former parts 24. FIGS. 8D to 8G show examples of possible end face formations which are illustrative only and not exhaustive. Other variations of end face formations are possible. The end face formations permit easier breaking or rupture of the root part 14 in the impact condition relative to prior art arrangements, while enhancing stability and/or strength against other imposed forces, such as those forces imposed during normal use and operating conditions. These features can be used to aid assembly during manufacture of the blade.

Figure 8D:
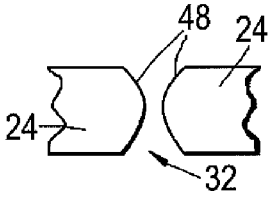
Figure 8E:
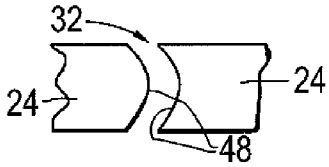
Figure 8F:
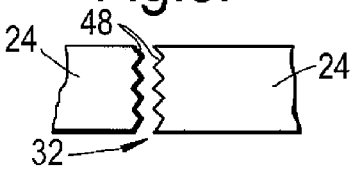
Figure 8G:
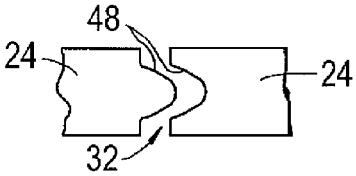

In FIG. 8D, each of the root former parts 24 includes an end face formation 48, which is convex. In FIG. 8E, one of the end face formations 48 is convex, and the other adjacent opposing end face formation is correspondingly concave. In FIG. 8F, the end face formations 48 include stipples or corrugations. In FIG. 8G, one of the end face formations 48 is in the form of a lobe, which is receivable within a recess defined by the other opposing end face formation 48.

The root former 18 could include a connector 42, which extends between each of the root former parts 24. The connectors permit easier breaking or rupture of the root part 14 in the impact condition relative to prior art arrangements, while enhancing stability and handling and/or strength against other imposed forces, such as those forces imposed during normal use and operating conditions. These connectors can be used to aid assembly during manufacture of the blade.

The examples shown in FIGS. 8H to 8L are illustrative only and not exhaustive. Other variations of connectors are possible.

Figure 8H:
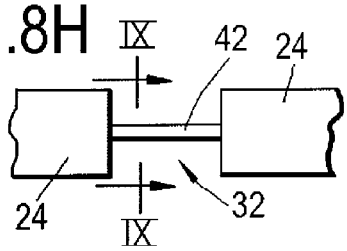
Figure 9A:
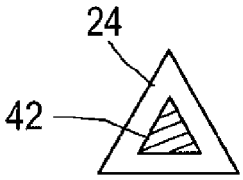
FIGS. 9A to 9C are end sectional views of a connector taken on the line IX-IX shown in FIG. 8H.
Figure 9B:
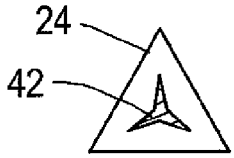
Figure 9C:
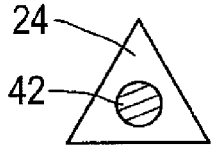

FIG. 8H shows a connector 42 in the form of a bar, which could be relatively rigid. The bar could be of any suitable cross sectional shape. FIGS. 9A to 9C show examples of possible cross sectional shapes. FIG. 9A shows a triangular cross sectional shape. FIG. 9B shows a three pointed star shape. FIG. 9C shows a circular cross sectional shape. Other shapes are possible and this is not an exhaustive list.

Figure 8I:
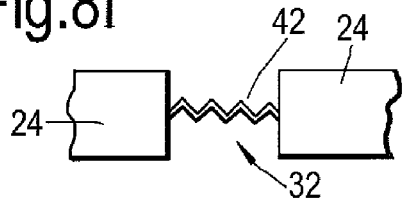
Figure 8J:
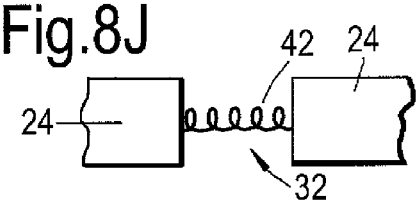
Figure 8K:
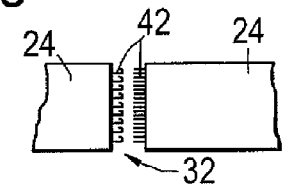
Figure 8L:
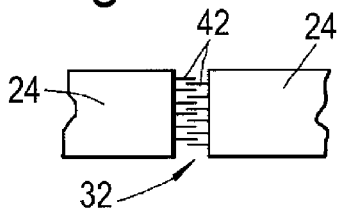

FIG. 8I shows a connector 42 in the form of a wavy rod. FIG. 8J shows a connector 42 in the form of a spiral. The connectors 42 shown in FIGS. 8I and 8J could have a resilient property. FIG. 8K shows a connector 42 in the form of a hook and loop connector. FIG. 8L shows a connector 42 in the form of a plurality of projections projecting from each of the end faces which in a connected condition interlock together.

Figure 8M:
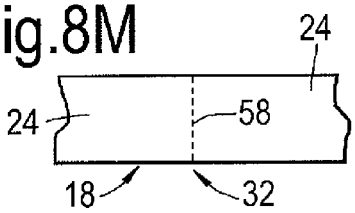

FIG. 8M shows a root former 18 comprising root former parts 24, the root former 18 including a zone of weakness 32 in the form of a line of weakness 58 extending between the root former parts 24. The line of weakness 58 could be formed in a number of ways. For example, the root former 18 could be perforated along the line of weakness 58. The root former 18 could be partially broken along the line of weakness 58. In an example in which the root former 18 is formed of carbon fibre, a proportion of the carbon fibres could be broken or disjointed along the line of weakness 58.

Figure 10A:
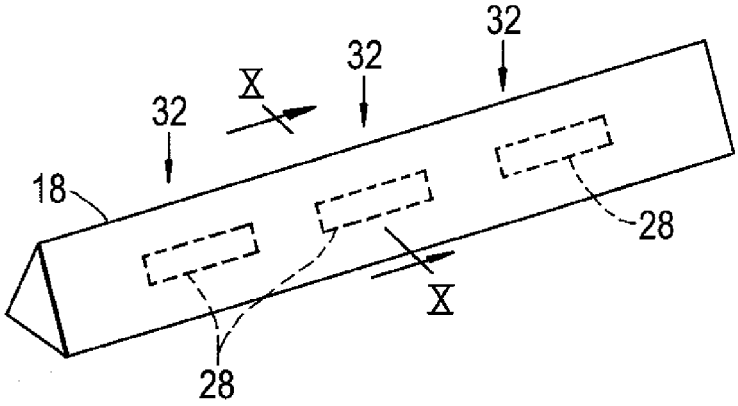
FIGS. 10A to 10D are perspective and end sectional views of another root former along the line X-X shown in FIG. 10A.
Figure 10B:
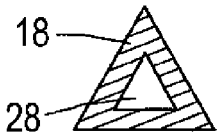
Figure 10C:
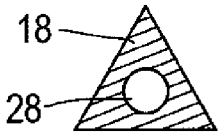
Figure 10D:
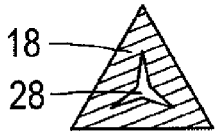

In FIGS. 10A to 10D, a root former 18 includes a plurality of zones of weakness 32, each zone of weakness including an internal space 28 defined by the root former 18. The internal spaces 28 could have any suitable cross sectional shape. FIGS. 10B to 10D show some examples of possible cross sectional shapes. These examples are not exhaustive and other shapes are possible. In FIG. 10B, the cross sectional shape of the internal space 28 is triangular. In FIG. 10C, the cross sectional shape of the internal space 28 is circular. In FIG. 10D, the cross sectional shape of the internal space 28 is a three-pointed star.

The root part 14 of the blade 10 could have a different shape. FIGS. 11A to 11F show examples of possible different cross sectional shapes of root parts. These examples are illustrative only and other shapes are possible and will be defined by the root retention mechanism of the blade and disc.

Figure 11A:
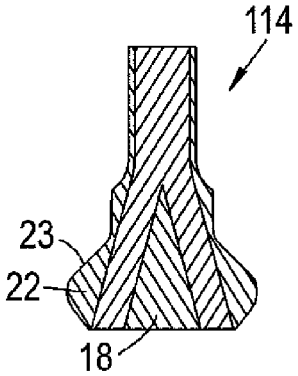
FIGS. 11A to 11F are end sectional views of a root part of other blades showing different shapes and incorporations of the root formers shown in FIGS. 5 to 10. These are variations on the basic section shown in FIG. 2.

In FIG. 11A, a root part 114 includes a root former 18 which has a cross sectional shape in the form of a triangle, and a surface layer 23 of settable material 22, the surface layer 23 having a plurality of surface formations. The surface formations could be metal coated or metal edged.

Figure 11B:
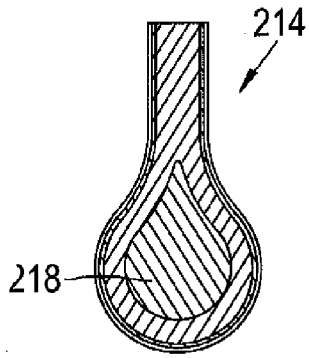

In FIG. 11B, a root part 214 has a cross sectional shape in the form of a droplet, and includes a root former 218 with a corresponding cross sectional shape.

Figure 11C:
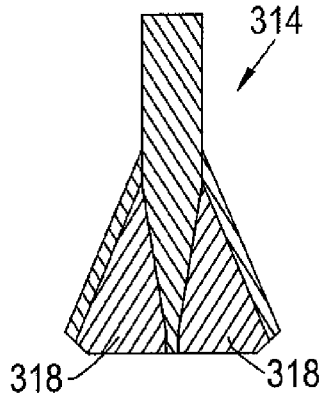

In FIG. 11C, a root part 314 has a "dual wedge" construction, including a pair of root formers 318 which extend along the length of the root part 314.

Figure 11D:
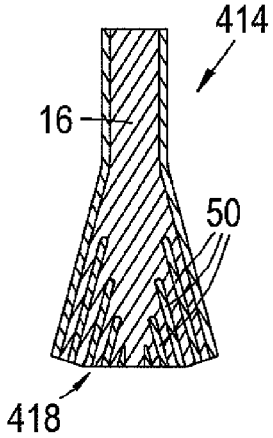

FIG. 11D shows a root part 414, which includes a root former 418, which is formed of a plurality of leaf members 50 which are interleaved with the structure 16.

Figure 11E:
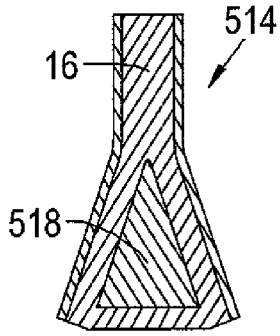

FIG. 11E shows a root part 514 including a root former 518, which is completely enclosed within the structure 16.

Figure 11F:
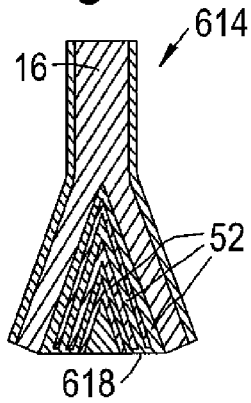

FIG. 11F shows a root part 614 including a root former 618, which includes a plurality of root former layers 52, which together form the root former 618.

Figure 12:
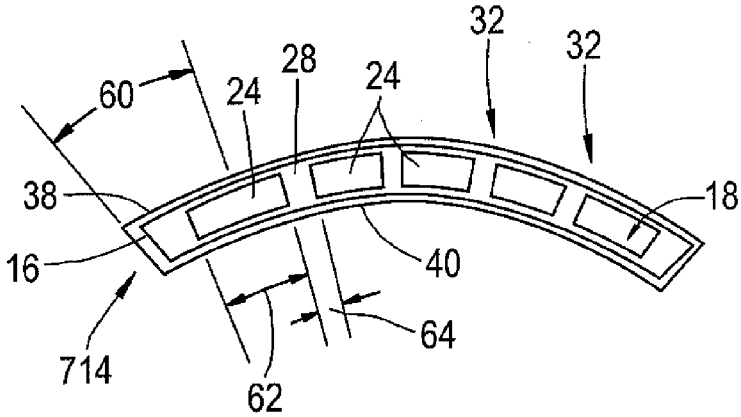
FIG. 12 is an axial section through the root part of a blade showing one possible distribution of the root former elements.

FIG. 12 shows a schematic cross section through another root part 714, the root part 714 including a root former 18 which includes a plurality of root former parts 24 and a plurality of zones of weakness 32 in the form of spaces 28 defined between the root former parts 24. As mentioned previously, although in many of the figures the root part 714 and the root former 18 have been shown as being linear, in practice, both the root part 714 and the root former 18 are curved in the form of an arc. As shown in FIG. 12, the length and the angular extent 62 of the root former parts 24 could vary. The angular position 60 of the root former parts 24 could vary. The length and the angular extent 64 of the spaces 28 could vary. The positioning of the former and the former material may be determined by the expected operating loads in order to prevent inadvertent premature crushing of part of the blade root section.

The features of any of the embodiments shown and/or described could be combined in any suitable way.

There is thus provided a blade having a root part including a root former including a zone of weakness, which reduces the ability of the root part to withstand an impact force. Thus, in an impact situation in which the blade has separated from the fan rotor and the blade has itself separated into fragments, the root part 14 will fracture or buckle more easily than would be the case with conventional arrangements, lowering the impact force of the root part upon the fan casing, and thus permitting the fan casing to be designed to withstand lower impact forces, resulting in the possibility of a material weight saving which could provide lower operating costs.

What is claimed is:

1. A blade for a turbine engine, comprising:

an aerofoil part, a root part; and a root former, including a zone of weakness, said root former included in said root part, in which the root former includes a plurality of root former parts, and one zone of weakness may be located between adjacent root former parts.

2. The blade according to claim 1, in which the zone of weakness includes a space defined between the adjacent root former parts.

3. The blade according to claim 2, in which the blade includes a filler material, which is located in the space.

4. The blade according to claim 2, in which each of the root former parts includes an end face, which includes a formation of adjacent root former parts.

* * * * *